US009341968B1

(12) United States Patent
Lawton et al.

(10) Patent No.: US 9,341,968 B1
(45) Date of Patent: May 17, 2016

(54) TONER PARTICLES COMPRISING BOTH POLYESTER AND STYRENE ACRYLATE POLYMERS HAVING A POLYESTER SHELL

(71) Applicant: XEROX CORPORATION, Norwalk, CT (US)

(72) Inventors: David Lawton, Oakville (CA); Edward G. Zwartz, Mississauga (CA); Kimberly D. Nosella, Mississauga (CA); Melanie Lynn Davis, Hamilton (CA); Richard P. N. Veregin, Mississauga (CA); Guerino G. Sacripante, Oakville (CA)

(73) Assignee: XEROX CORPORATION, Norwalk, CT (US)

( * ) Notice: Subject to any disclaimer, the term of this patent is extended or adjusted under 35 U.S.C. 154(b) by 0 days.

(21) Appl. No.: 14/676,509

(22) Filed: Apr. 1, 2015

(51) Int. Cl.
*G03G 9/08* (2006.01)
*G03G 9/087* (2006.01)
*G03G 9/093* (2006.01)

(52) U.S. Cl.
CPC ..... *G03G 9/0808* (2013.01); *G03G 9/081* (2013.01); *G03G 9/0806* (2013.01); *G03G 9/0825* (2013.01); *G03G 9/08711* (2013.01); *G03G 9/08733* (2013.01); *G03G 9/093* (2013.01); *G03G 9/09392* (2013.01)

(58) Field of Classification Search
CPC ... G03G 9/0806; G03G 9/081; G03G 9/0825; G03G 9/08711; G03G 9/08733; G03G 9/093; G03G 9/09392
USPC ..... 430/137.14, 110.2
See application file for complete search history.

(56) References Cited

U.S. PATENT DOCUMENTS 7,358,021 B2 4/2008 Patel et al.
7,442,740 B2 10/2008 Patel et al.

OTHER PUBLICATIONS

U.S. Appl. No. 14/676,757, filed Apr. 1, 2015 entitled, Toner Particles Comprising Both Polyester and Styrene Acrylate Polymers Having a Polyester Shell.

*Primary Examiner* — Mark A Chapman
(74) *Attorney, Agent, or Firm* — Shimokaji IP

(57) ABSTRACT

The disclosure provides a toner composition comprising toner particles with a core and a shell, wherein the core comprises a polyester polymer and a styrene acrylate polymer, and the shell comprises a polyester polymer and, optionally, a styrene acrylate polymer, either or both of which can be the same or different from that in the core.

18 Claims, 1 Drawing Sheet

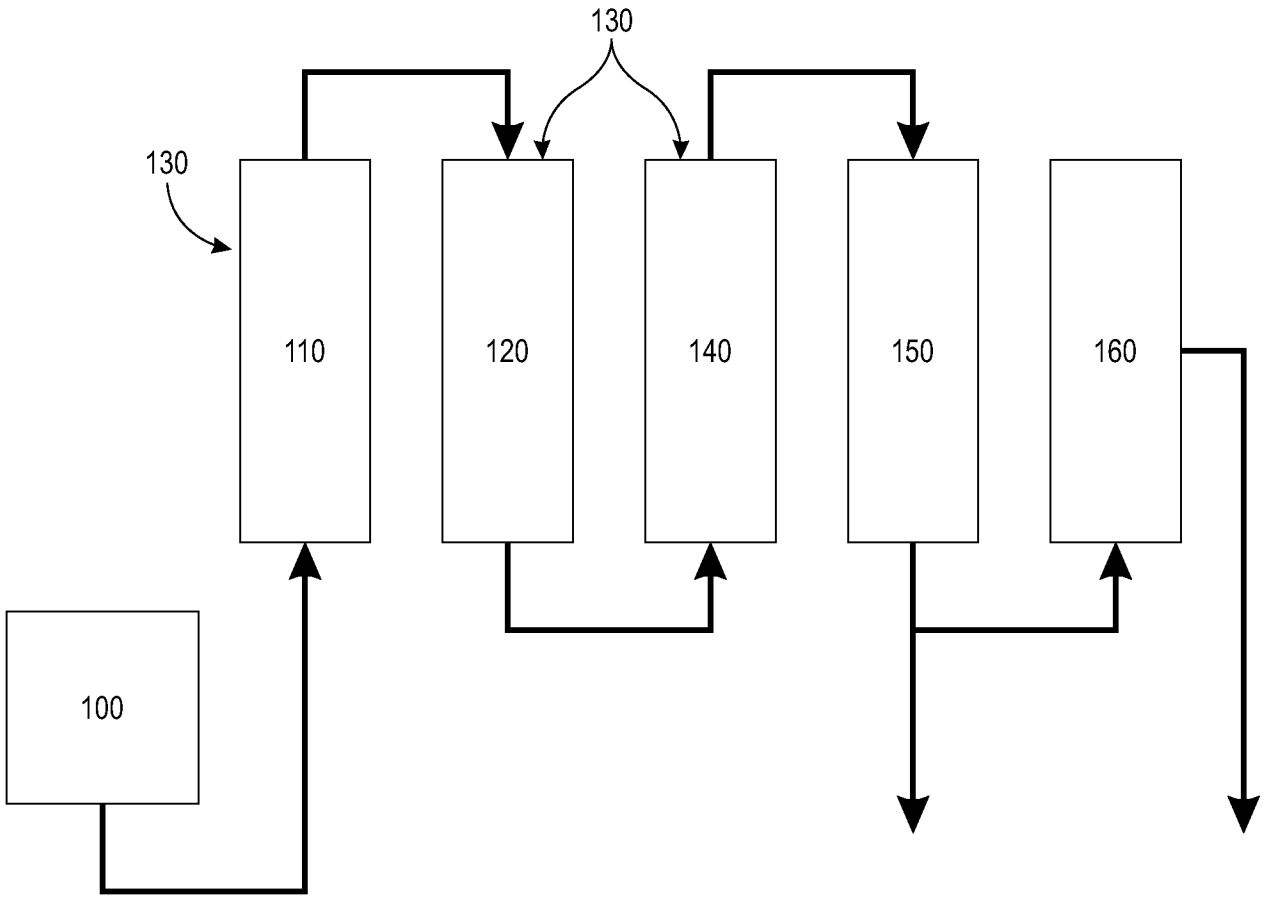
130
110
120
130
140
150
160
100

TONER PARTICLES COMPRISING BOTH POLYESTER AND STYRENE ACRYLATE POLYMERS HAVING A POLYESTER SHELL

TECHNICAL FIELD

The disclosure is generally directed to hybrid toner particles and methods for their preparation for use in forming toners. More specifically, the disclosure is directed to hybrid latex particles having a core of polyester and styrene acrylate polymers with a shell comprised largely of polyester, and methods for their preparation for use in forming toners.

BACKGROUND

Toners made by emulsion aggregation processes are useful in forming print and xerographic images. Emulsion aggregation processes typically involve the formation of a latex emulsion of polymer particles by heating a polymer in water, optionally with a solvent if needed, or by forming a latex emulsion of polymer particles using phase inversion emulsion (PIE). Additives such as emulsifying agents or surfactants, colorants, waxes, aggregating agents, and others may be included in the emulsion. The resulting latex particles may then be aggregated to form aggregated toner particles. Optionally, a second latex emulsion of polymer particles may be added to the aggregated toner particles, which upon further aggregation forms a shell on the aggregated toner particles. The resulting aggregated toner particles may be heated in a batch or continuous process to allow coalescence/fusing to occur, thereby providing aggregated, fused toner particles with increased circularity.

Various hybrid toner particles have been prepared. However, there remains a need for hybrid toner particles and methods for their preparation for use in toners for high speed printing, particularly high speed monochrome printing that provides excellent flow, charging, lower toner usage, and reduced drum contamination.

SUMMARY

The following detailed description is of the best currently contemplated mode of carrying out exemplary embodiments herein. The description is not to be taken in a limiting sense, but is made merely for the purpose of illustrating the general principles of the exemplary embodiments herein, since the scope of the disclosure is best defined by the appended claims.

Various inventive features are described below that can each be used independently of one another or in combination with other features.

Broadly, embodiments of the disclosure herein generally provide a toner composition comprising toner particles having a core and a shell, wherein the core includes a polyester polymer and a styrene acrylate polymer, and wherein the shell includes the polyester polymer and optionally the styrene acrylate polymer.

In another embodiment of the disclosure herein, a toner composition includes toner particles having a core and a shell, wherein the core includes a first polyester polymer and a first styrene acrylate polymer, and wherein the shell includes substantially a second polyester polymer.

In yet another embodiment of the disclosure herein, a method for preparing a toner composition includes forming toner particles having a core and a shell, wherein forming includes coalescing the toner particles by a continuous coalescence process, wherein the core includes a polyester polymer and a styrene acrylate polymer, and wherein the particles have a fusing latitude of from about 100° C. to about 240° C.

BRIEF DESCRIPTION OF THE FIGURES

Various embodiments of the present disclosure can be described herein below with reference to the following figures wherein:

FIG. 1 illustrates a continuous coalescence process according to an embodiment herein.

DETAILED DESCRIPTION

Although specific terms are used in the following description for the sake of clarity, these terms are intended to refer only to the particular structure of the embodiments selected for illustration in the drawings, and are not intended to define or limit the scope of the disclosure. In the drawings and the following description below, it is to be understood that like numeric designations refer to components of like function.

In the present disclosure, the singular forms "a," "an," and "the" include plural referents unless the context clearly dictates otherwise.

In the present disclosure, numerical values in the specification and claims of this application should be understood to include numerical values which are the same when reduced to the same number of significant figures and numerical values which differ from the stated value by less than the experimental error of conventional measurement technique of the type described in the present application to determine the value.

In the present disclosure, all ranges disclosed herein are inclusive of the recited endpoint and independently combinable (for example, the range of "from 2 grams to 10 grams" is inclusive of the endpoints, 2 grams and 10 grams, and all the intermediate values).

In the present disclosure, a value modified by a term or terms, such as "about" and "substantially," may not be limited to the precise value specified. The modifier "about" should also be considered as disclosing the range defined by the absolute values of the two endpoints. For example, the expression "from about 2 to about 4" also discloses the range "from 2 to 4."

In the present disclosure, the term "continuous" refers to a system where the inlet flow rate substantially equals the outlet flow rate, and the flow of material in and out of the system occurs substantially simultaneously. However, it should be understood that this material flow may be periodically stopped, for example, for maintenance purposes.

In the present disclosure, the fixing performance of a toner may be characterized as a function of temperature. The lowest temperature at which a toner adheres to the support medium is called the "cold offset temperature" (CO temperature).

In the present disclosure, the maximum temperature at which a toner does not adhere to a fuser roll is called the "hot offset temperature" (HO temperature). When the fuser temperature exceeds the hot offset temperature, some of the molten toner adheres to the fuser roll during fixing and is transferred to subsequent substrates containing developed images resulting in blurred images. This undesirable phenomenon is called "offsetting."

Between the cold offset temperature and hot offset temperature of the toner is the "minimum fix temperature" (MFT), which is the minimum temperature at which acceptable adhesion of the toner to the support medium occurs, that is, as determined by for example a creasing test.

In the present disclosure, a crease test or a creasing test is a method for assessing how well toner is adhered to paper. In a crease test, a printed solid area is literally creased (folded), and the toner that has been loosened from the paper as a result of the creasing is either brushed or blown away. The width, brightness and area of the resulting line indicate the amount of toner that has been disrupted. When toner is not well-adhered, more toner will be disrupted from the crease and this line will be wider and much more apparent.

In the present disclosure, the temperature at which significant sintering or coalescing of the toner particles occurs when not in use is called the "blocking temperature." Toners having high hot offset temperatures and high blocking temperatures are desired.

In the present disclosure, the phrase "mottle temperature" refers to the temperature of the toner composition when mottle appears. "Mottle" is the result of an uneven ink layer or non-uniform ink absorption across the paper surface, especially visible in mid-tone imagery or areas of uniform color such as solids and continuous-tone screen builds. This visible non-uniformity may be the result of differential ink gloss, density, or color of the printed ink film; or it may be a variable function of randomly connected and disconnected mid-tone dots.

In the present disclosure "fusing latitude" refers to the temperature range between the minimum fix temperature (MFT) and the hot offset (HO) temperature on a particular paper. It is desirable to have a wide range of fusing latitude.

In the present disclosure, a "solvent ratio" refers to the amount of a polymer to the amount of solvent(s), i.e., it is a measure of the concentration of the polymer.

In the present disclosure, a "neutralization ratio" refers to the amount of base required to neutralize a polymer's acidic groups. For example, a neutralization ratio of 1.0 or 100% implies that every acidic moiety in the polymer is neutralized by a base. A neutralization ratio of 110% implies that 10% additional base was utilized to neutralize 100% of the polymer based on the acid value. A neutralization ratio of 85% implies that 15% less base was utilized to neutralize 100% of the polymer based on the acid value.

In the present disclosure, "distillation" refers to a method of separating mixtures of components based on the differences in volatility of the components in a boiling liquid mixture. Distillation is a physical separation process and not a chemical reaction.

In the present disclosure, "average particle size" refers to a volume average size that may be determined using any suitable device, for example a conventional Coulter counter. The circularity of the particles may be determined using any suitable method, for example the known Malvern Sysmex Flow Particle Integration Analysis method. The circularity is a measure of the particles closeness to perfectly spherical. A circularity of 1.0 identifies a particle having the shape of a perfect circular sphere.

The particle diameters at which a cumulative percentage of 50% of the total toner particles are attained are defined as volume D50, and the particle diameters at which a cumulative percentage of 84% are attained are defined as volume D84. These aforementioned volume average particle size distribution indexes GSDv can be expressed by using D50 and D84 in cumulative distribution, wherein the volume average particle size distribution index GSDv is expressed as (volume D84/volume D50.

These aforementioned number average particle size distribution indexes GSDn can be expressed by using D50 and D16 in cumulative distribution, wherein the number average particle size distribution index GSDn is expressed as (number D50/number D16). The closer to 1.0 that the GSD value is, the less size dispersion there is among the particles.

Hybrid Toner Particles

In embodiments herein, toner particles are referred to as "hybrid" because they are a mixture of two or more different polymers. The hybrid toner particles have a core/shell structure. According to certain embodiments, the core can be a mixture of one or more polyester polymers and one or more styrene acrylate polymers.

In embodiments, the shell can be of one or more polyester polymers and, optionally, one or more styrene acrylate polymers. Accordingly, in some embodiments, the shell can be substantially (i.e., more than about 50%) of one or more polyester polymers and, to a lesser extent, one or more styrene acrylate polymers. In additional embodiments, the shell can be essentially (i.e., about 90% or more) of one or more polyester polymers, and to the essential exclusion of one or more styrene acrylate polymers. In further embodiments, the shell can be of substantially (i.e., more than about 50%) of one or more styrene acrylate polymers and, to a lesser extent, one or more polyester polymers.

In further embodiments, the polyester polymer(s) of the core and shell can be the same or different. Likewise, the styrene acrylate polymer(s) of the core and shell can be the same or different.

The hybrid toner particles herein may also include other additives, for example, one or more colorants or pigments, one or more emulsifying agents or surfactants, one or more waxes, one or more aggregating agents, one or more coagulants, and/or one or more other optional additives. Any suitable emulsion aggregation procedure may be used and/or modified to prepare the hybrid toner particles of the present disclosure.

In embodiments, the hybrid toner particles may have a cold offset temperature of from about 100° C. to about 125° C., or from about 105° C. to about 120° C., or from about 110° C. to about 115° C.

In embodiments, the hybrid toner particles may have a hot offset temperature of from about 200° C. to about 240° C., or from about 205° C. to about 230° C., or from about 210° C. to about 220° C.

In embodiments, the hybrid toner particles may have a fusion latitude of from about 100° C. to about 240° C., or from about 110° C. to about 220° C., or from about 120° C. to about 210° C.

In embodiments, the hybrid toner particles, exclusive of surface additives, may have the following characteristics: (1) volume average diameter (also referred to as "volume average particle diameter") of from about 2.5 to about 20 μm, or from about 2.75 to about 10 μm, or from about 3 to about 7.5 μm; (2) number average geometric standard deviation (GSDn) of from about 1.10 to about 1.30, or from about 1.15 to about 1.25, or from about 1.20 to about 1.23; (3) volume average geometric standard deviation (GSDv) of from about 1.10 to about 1.30, or from about 1.15 to about 1.25, or from about 1.20 to about 1.23; and (4) circularity (measured with, for example, a Sysmex FPIA 2100 analyzer) of from about 0.9 to about 1.0, or from about 0.950 to about 0.985, or from about 0.960 to about 0.980, or from about 0.960 to about 0.970, or about 0.965.

In embodiments, the hybrid toner particles may have a minimum fix temperature (MFT) of from about 100° C. to about 130° C., or from about 105° C. to about 125° C., or from about 110° C. to about 120° C.

In embodiments, the MFT for continuously coalesced (described below) hybrid toner particles herein having a core mixture of polyester polymer(s) and styrene acrylate polymer(s) and a shell of substantially polyester polymer(s) may be about 118° C.

Polyester Polymers

In embodiments, any polyester polymer(s) known in the art may be utilized in the disclosed embodiments to form the hybrid latex particles. For example, the polymer(s) may be an amorphous polyester polymer, a crystalline polyester polymer, and/or various combinations thereof.

In embodiments, the polyester polymer may be present in the toner particles herein, for example, in an amount of from about 5% to about 95% by weight of the resin, or from about 15% to about 85% by weight, or from about 25% to about 75% by weight.

In embodiments, the polyester polymer(s) may be present in the core of the hybrid toner particles in an amount of from about 5 weight % to about 95 weight %, or from about 15 weight % to about 85 weight %, or from about 25 weight % to about 75 weight %, or from about 30 weight % to about 70 weight %, or from about 40 weight % to about 60 weight %, or about 50 weight % of the core polymers.

In embodiments, the polyester polymer(s) may be present in the shell of the hybrid toner particles in an amount of from about 5 weight % to about 100 weight %, or from about 10 weight % to about 90 weight %, or from about 20 weight % to about 80 weight %, or from about 30 weight % to about 70 weight %, or from about 40 weight % to about 60 weight %, or about 50 weight % of the shell polymers.

Suitable amorphous polyester polymers include but are not limited to ethoxylated and propoxylated bis-phenol-A derived polyester polymers. Other suitable polymers include saturated or unsaturated amorphous polyester polymers; high molecular weight or low molecular weight amorphous polyester polymers; and bis-phenol-A derived amorphous polyester polymers. Other useful amorphous polyester polymers include those described in U.S. Pat. Nos. 8,192,913; 6,830,860; 6,756,176; 6,593,049; and 6,063,827; and U.S. Patent Application Publication Nos. 2013/0164668 and 2006/0222991, the disclosures of which are hereby incorporated by reference in their entireties. In addition, amorphous polyester polymers include those obtained from the reaction of bis-phenol-A and propylene oxide or propylene carbonate, followed by the reaction of the resulting product with fumaric acid as disclosed in U.S. Pat. No. 5,227,460, the disclosure of which is hereby incorporated by reference in its entirety.

In embodiments, a suitable amorphous polyester polymer may be based on any combination of propoxylated and/or ethoxylated bis-phenol-A, terephthalic acid, fumaric acid, and dodecenyl succinic anhydride. For example, the polyester polymer may have formula I:

(I)

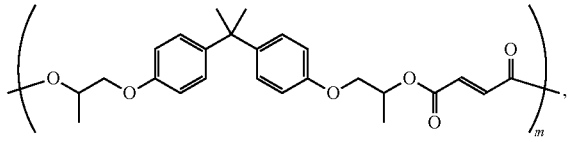

wherein m may be from about 5 to about 1000.

In embodiments, propoxylated bis-phenol-A derived polyester polymers available from Kao Corporation, Japan, may be utilized. These polymers include acid groups and may be of low molecular weight or high molecular weight.

In embodiments, a high molecular weight amorphous polyester polymer may have a weight average molecular weight of from about 40,000 g/mol to about 150,000 g/mol, or from about 50,000 g/mol to about 140,000 g/mol, or from about 60,000 g/mol to about 125,000 g/mol of polymer. A low molecular weight amorphous polyester polymer may have a weight average molecular weight of from about 10,000 g/mol to about 40,000 g/mol, or from about 15,000 g/mol to about 30,000 g/mol, or from about 20,000 g/mol to about 25,000 g/mol of polymer.

In embodiments, the amorphous or crystalline polyester polymer may be formed by the polycondensation process of reacting a diol with a diacid in the presence of an optional catalyst.

Examples of diacid or diesters selected for the preparation of amorphous polyesters include dicarboxylic acids or diesters such as terephthalic acid, phthalic acid, isophthalic acid, furnaric acid, maleic acid, succinic acid, itaconic acid, succinic acid, succinic anhydride, dodecylsuccinic acid, dodecylsuccinic anhydride, glutaric acid, glutaric anhydride, adipic acid, pimelic acid, suberic acid, azelaic acid, dodecanediacid, dimethyl terephthalate, diethyl terephthalate, dimethyl-isophthalate, diethylisophthalate, dimethylphthalate, phthalic anhydride, diethylphthalate, dimethylsuccinate, dimethylfumarate, dimethylmaleate, dimethyl-glutarate, dimethyladipate, dimethyl dodecylsuccinate, and combinations thereof. The organic diacid or diester may be selected, for example, from about 40 to about 60 mole percent of the polymer.

Examples of diols utilized in generating the amorphous polyester include 1,2-propanediol; 1,3-propanediol; 1,2-butanediol; 1,3-butanediol; 1,4-butanediol; pentanediol; hexanediol; 2,2-dimethylpropanediol; 2,2,3-trimethylhexanediol; heptanediol; dodecanediol; bis(hyroxyethyl)-bis-phenol-A; bis(2-hydroxypropyl)-bis-phenol-A; 1,4-cyclohexanedimethanol; 1,3-cyclohexanedimethanol; xylene-dimethanol; cyclohexane-diol; diethylene glycol; bis(2-hydroxyethyl) oxide; dipropylene glycol; dibutylene; and combinations thereof. The amount of organic diol selected may vary, and may be, for example, from about 40 to about 60 mole percent of the polymer.

Examples of other amorphous polymers which may be utilized include alkali sulfonated-polyester polymers and branched alkali sulfonated-polyester polymers. Alkali sulfonated polyester polymers may be useful in embodiments, such as the metal or alkali salts of copoly(ethylene-terephthalate)-copoly(ethylene-5-sulfo-isophthalate), copoly-(propylene-terephthalate)-copoly(propylene-5-sulfo-isophthalate), copoly-(di-ethylene-terephthalate)-copoly(diethylene-5-sulfo-isophthalate), copoly-(propyl-ene-di-ethylene-terephthalate)-copoly(propylene-diethylene-5-sulfoisophthalate), copoly-(propylene-butylene-terephthalate)-copoly(propylene-butylene-5-sulf-o-iso-phthalate), copoly-(propoxylated bisphenol-A-fumarate)-copoly(propoxylated bis-phenol-A-5-sulfo-iso-phthalate), copoly(ethoxylated bisphenol-A-fumarate)-copoly-(ethoxylated bis-phenol-A-5-sulfo-isophthalate), and copoly(ethoxylated bisphenol-A-maleate)-copoly-(ethoxylated bisphenol-A-5-sulfo-isophthalate), and wherein the alkali metal is, for example, a sodium, lithium or potassium ion.

For forming a crystalline polyester, suitable organic diols include aliphatic diols with from about 2 to about 36 carbon atoms, such as 1,2-ethanediol; 1,3-propanediol; 1,4-butanediol; 1,5-pentanediol; 1,6-hexanediol; 1,7-heptanediol; 1,8-octanediol; 1,9-nonanediol; 1,10-decanediol; 1,12-dodecanediol and the like; alkali sulfo-aliphatic diols such as sodium 2-sulfo-1,2-ethanediol; lithium 2-sulfo-1,2-ethanediol; potassium 2-sulfo-1,2-ethanediol; sodium 2-sulfo-1,3-propanediol; lithium 2-sulfo-1,3-propanediol; potassium 2-sulfo-1,3-propanediol; mixtures thereof; and the like. The aliphatic diol may be, for example, selected in an amount of from about 40 to about 60 mole percent of the polymer, and the alkali sulfo-aliphatic diol may be selected in an amount of from about 1 to about 10 mole percent of the polymer.

Examples of organic diacids or diesters selected for the preparation of the crystalline polymers include oxalic acid, succinic acid, glutaric acid, adipic acid, suberic acid, azelaic acid, sebacic acid, phthalic acid, isophthalic acid, terephthalic acid, naphthalene-2,6-dicarboxylic acid, naphthalene-2,7-dicarboxylic acid, cyclo-hexane dicarboxylic acid, malonic acid and mesaconic acid, a diester or anhydride thereof; The organic diacid may be selected in an amount of, for example, from about 40 to about 60 mole percent, from about 42 to about 52 mole percent, or from about 45 to about 50 mole percent. and an alkali sulfo-organic diacid such as the sodium, lithium or potassium salt of dimethyl-5-sulfo-isophthalate; dialkyl-5-sulfo-isophthalate-4-sulfo-1,8-naphthalic anhydride; 4-sulfo-phthalic acid; dimethyl-4-sulfo-phthalate; dialkyl-4-sulfo-phthalate; 4-sulfophenyl-3,5-dicarbomethoxybenzene; 6-sulfo-2-naphthyl-3,5-dicarbomethoxybenzene; sulfo-terephthalic acid; dimethyl-sulfo-terephthalate; 5-sulfo-isophthalic acid; dialkyl-sulfoterephthalate; sulfoethanediol; 2-sulfopropane-diol; 2-sulfobutanediol; 3-sulfo-pentanediol; 2-sulfohexanediol; 3-sulfo-2-methyl-pentanediol; 2-sulfo-3,3-dimethyl-pentanediol; sulfo-p-hydroxybenzoic acid; N,N-bis(2-hydroxyethyl)-2-amino ethane sulfonate; or mixtures thereof. The organic diacid may be selected in an amount of, for example, from about 40 to about 60 mole percent of the polymer, and the alkali sulfo-aliphatic diacid may be selected in an amount of from about 1 to about 10 mole percent of the polymer.

Some specific crystalline polyester polymers may include poly(ethylene-adipate), poly(propylene-adipate), poly(butylene-adipate), poly(pentylene-adipate), poly-(hexylene-adipate), poly(octylene-adipate), poly(ethylene-succinate), poly-(propylene-succinate), poly(butylene-succinate), poly (pentylene-succinate), poly-(hexylene-succinate), poly(octylene-succinate), poly(ethylene-sebacate), poly-(propylene-sebacate), poly(butylene-sebacate), poly(pentylene-sebacate), poly-(hexylene-sebacate), poly(octylene-sebacate), alkali copoly(5-sulfoisophthaloyl)-copoly (ethylene-adipate), alkali copoly(5-sulfoisophthaloyl)-copoly(propylene-adipate), alkali copoly(5-sulfoisophthaloyl)-copoly(butylene-adipate), alkali copoly-(5-sulfo-isophthaloyl)-copoly-(pentylene-adipate), alkali copoly(5-sulfo-iso-phthaloyl)-copoly(hexylene-adipate), alkali copoly(5-sulfo-isophthaloyl)-copoly-(octylene-adipate), alkali copoly(5-sulfo-isophthaloyl)-copoly(ethylene-adipate), alkali copoly(5-sulfo-isophthaloyl)-copoly-(propylene-adipate), alkali copoly(5-sulfo-isophthaloyl)-copoly (butylene-adipate), alkali copoly(5-sulfo-isophthaloyl)-copoly-(pentylene-adipate), alkali copoly(5-sulfo-isophthaloyl)-copoly(hexylene-adipate), alkali copoly(5-sulfo-isophthaloyl)-copoly-(octylene-adipate), alkali copoly(5-sulfo-isophthaloyl)-copoly(ethylene-succinate), alkali copoly(5-sulfoisophthaloyl)-copoly-(propylene-succinate), alkali copoly(5-sulfoiso-phthaloyl)-copoly(butylenes-succinate), alkali copoly(5-sulfoisophthaloyl)-copoly-(pentylene-succinate), alkali copoly(5-sulfoisophthaloyl)-copoly(hexylene-succinate), alkali copoly(5-sulfo-isophthaloyl)-copoly (octylene-succinate), alkali copoly(5-sulfo-isophthaloyl)-copoly-(ethylene-sebacate), alkali copoly(5-sulfo-isophthaloyl)-copoly(propylene-sebacate), alkali copoly(5-sulfo-isophthaloyl)-copoly-(butylene-sebacate), alkali copoly(5-sulfo-isophthaloyl)-copoly(pentylene-sebacate), alkali copoly-(5-sulfo-iso-phthaloyl)-copoly(hexylene-sebacate), alkali copoly-(5-sulfo-iso-phthaloyl)-copoly-(octylene-sebacate), alkali copoly(5-sulfo-isophthaloyl)-copoly-(ethylene-adipate), alkali copoly(5-sulfo-isophthaloyl)-copoly-(propylene-adipate), alkali copoly(5-sulfo-isophthaloyl)-copoly(butylene-adipate), alkali copoly(5-sulfo-isophthaloyl)-copoly-(pentylene-adipate), alkali copoly(5-sulfo-isophthaloyl)-copoly-(hexylene-adipate), and poly(octylene-adipate), wherein alkali is a metal like sodium, lithium or potassium The crystalline polymer may have a melting point of, for example, from about 30° C. to about 120° C., or from about 50° C. to about 90° C. The crystalline polymer may have a number average molecular weight (Mn), as measured by gel permeation chromatography (GPC) of, for example, from about 1,000 to about 50,000, or from about 2,000 to about 25,000; and a weight average molecular weight (Mw) of, for example, from about 2,000 to about 100,000, or from about 3,000 to about 80,000, as determined by gel permeation chromatography using polystyrene standards. The molecular weight distribution (Mw/Mn) of the crystalline polymer may be, for example, from about 2 to about 6, or from about 2 to about 4.

Styrene Acrylate Polymers

In embodiments, any styrene acrylate polymer(s) known in the art may be utilized in the disclosed embodiments to form the hybrid latex particles. For convenience, the term "acrylic" will be used with the understanding that this term encompasses both the acrylic and methacrylic forms. Exemplary emulsion aggregation latex copolymers of styrene and acrylate are illustrated in U.S. Pat. No. 6,120,967, the disclosure of which is hereby incorporated by reference in its entirety.

In embodiments, the styrene acrylate polymer(s) may be present in the toner particles herein, for example, in an amount of from about 5% to about 95% by weight of the resin, or from about 15% to about 85% by weight, or from about 25% to about 75% by weight.

In embodiments, the styrene acrylate polymer(s) may be present in the core of the hybrid toner particles in an amount of from about 5 weight % to about 95 weight %, or from about 10 weight % to about 90 weight %, or from about 20 weight % to about 80 weight %, or from about 30 weight % to about 70 weight %, or from about 40 weight % to about 60 weight % or about 50 weight % of the core polymers.

In embodiments, the styrene acrylate polymer(s) may be present in the shell of the hybrid toner particles in an amount of from about 0 weight % to about 95 weight %, or from about 10 weight % to about 90 weight %, or from about 20 weight % to about 80 weight %, or from about 30 weight % to about 70 weight %, or from about 40 weight % to about 60 weight % or about 50 weight % of the shell polymers.

In embodiments, exemplary polymers include styrene acrylates and, more specifically, polymers of styrene alkyl substituted acrylates. In embodiments, the acrylate component may be a water-insoluble ethylenically unsaturated ester of acrylic acid with a $C_1$ to $C_{18}$ alcohol. Examples of such acrylates include but are not limited to methyl acrylate, ethyl acrylate, propyl acrylate, butyl acrylate, pentyl acrylate, hexyl acrylate, and the like.

In embodiments, non-polyester latex resins formed by emulsion polymerization may be used. Generally, the latex resin may be composed of a first and a second monomer composition. Any suitable monomer or mixture of monomers may be selected to prepare the first monomer composition and the second monomer composition. The selection of monomer or mixture of monomers for the first monomer composition is independent of that for the second monomer composition and vice versa. In case a mixture of monomers is used, typically the latex polymer will be a copolymer. As discussed above, the latex resin is composed of at least styrene acrylate, a polyester resin and a crystalline resin.

Exemplary monomers for the first and/or the second monomer compositions include, but are not limited to, polyesters, styrene, alkyl acrylate, such as, methyl acrylate, ethyl acrylate, butyl arylate, isobutyl acrylate, dodecyl acrylate, n-octyl acrylate, 2-chloroethyl acrylate; β-carboxy ethyl acrylate (β-CEA), phenyl acrylate, methyl alphachloroacrylate, methyl methacrylate, ethyl methacrylate and butyl methacrylate; butadiene; isoprene; methacrylonitrile; acrylonitrile; vinyl ethers, such as, vinyl methyl ether, vinyl isobutyl ether, vinyl ethyl ether and the like; vinyl esters, such as, vinyl acetate, vinyl propionate, vinyl benzoate and vinyl butyrate; vinyl ketones, such as, vinyl methyl ketone, vinyl hexyl ketone and methyl isopropenyl ketone; vinylidene halides, such as, vinylidene chloride and vinylidene chlorofluoride; N-vinyl indole; N-vinyl pyrrolidone; methacrylate; acrylic acid; methacrylic acid; acrylamide; methacrylamide; vinylpyridine; vinylpyrrolidone; vinyl-N-methylpyridinium chloride; vinyl naphthalene; p-chlorostyrene; vinyl chloride; vinyl bromide; vinyl fluoride; ethylene; propylene; butylenes; isobutylene; and the like, and mixtures thereof.

In some embodiments, the first monomer composition and the second monomer composition may independently of each other comprise two or three or more different monomers. (side note—sounds very similar to my entry above) The latex polymer therefore can comprise a copolymer. Illustrative examples of such a latex copolymer includes poly(styrene-n-butyl acrylate-β-CEA), poly(styrene-alkyl acrylate), poly (styrene-1,3-diene), poly(styrene-alkyl methacrylate), poly (alkyl methacrylate-alkyl acrylate), poly(alkyl methacrylate-aryl acrylate), poly(aryl methacrylate-alkyl acrylate), poly (alkyl methacrylate), poly(styrene-alkyl acrylate-acrylonitrile), poly(styrene-1,3-diene-acrylonitrile), poly (alkyl acrylate-acrylonitrile), poly(styrene-butadiene), poly (methylstyrene-butadiene), poly(methyl methacrylate-butadiene), poly(ethyl methacrylate-butadiene), poly(propyl methacrylate-butadiene), poly(butyl methacrylate-butadiene), poly(methyl acrylate-butadiene), poly(ethyl acrylate-butadiene), poly(propyl acrylate-butadiene), poly(butyl acrylate-butadiene), poly(styrene-isoprene), poly(methylstyrene-isoprene), poly(methyl methacrylate-isoprene), poly(ethyl methacrylate-isoprene), poly(propyl methacrylate-isoprene), poly(butyl methacrylate-isoprene), poly(methyl acrylate-isoprene), poly(ethyl acrylate-isoprene), poly(propyl acrylate-isoprene), poly(butyl acrylate-isoprene); poly(styrene-propyl acrylate), poly(styrene-butyl acrylate), poly(styrene-butadiene-acrylonitrile), poly(styrene-butyl acrylate-acrylononitrile), and the like.

In embodiments, the first monomer composition and the second monomer composition may be substantially water insoluble, such as, hydrophobic, and may be dispersed in an aqueous phase with adequate stirring when added to a reaction vessel.

The weight ratio between the first monomer composition and the second monomer composition may be in the range of from about 0.1:99.9 to about 50:50, including from about 0.5:99.5 to about 25:75, from about 1:99 to about 10:90.

In embodiments, the first monomer composition and the second monomer composition can be the same. Examples of the first/second monomer composition may be a mixture comprising styrene and alkyl acrylate, such as, a mixture comprising styrene, n-butyl acrylate and β-CEA. Based on total weight of the monomers, styrene may be present in an amount from about 1% to about 99%, from about 50% to about 95%, from about 70% to about 90%, although may be present in greater or lesser amounts; alkyl acrylate, such as, n-butyl acrylate, may be present in an amount from about 1% to about 99%, from about 5% to about 50%, from about 10% to about 30%, although may be present in greater or lesser amounts.

Initiators

Any suitable initiator or mixture of initiators may be selected in the latex process and the toner process. In embodiments, the initiator is selected from known free radical polymerization initiators. The free radical initiator can be any free radical polymerization initiator capable of initiating a free radical polymerization process and mixtures thereof, such free radical initiator being capable of providing free radical species on heating to above about 30° C.

Although water soluble free radical initiators are used in emulsion polymerization reactions, other free radical initiators also can be used. Examples of suitable free radical initiators include, but are not limited to, peroxides, such as, ammonium persulfate, hydrogen peroxide, acetyl peroxide, cumyl peroxide, tert-butyl peroxide, propionyl peroxide, benzoyl peroxide, chlorobenzoyl peroxide, dichlorobenzoyl peroxide, bromomethylbenzoyl peroxide, lauroyl peroxide, diisopropyl peroxycarbonate, tetralin hydroperoxide, 1-phenyl-2-methylpropyl-1-hydroperoxide and tert-butylhydroperoxide; pertriphenylacetate, tert-butyl performate; tert-butyl peracetate; tert-butyl perbenzoate; tert-butyl perphenylacetate; tert-butyl permethoxyacetate; tert-butyl per-N-(3-toluyl)carbamate; sodium persulfate; potassium persulfate, azo compounds, such as, 2,2'-azobispropane, 2,2'-dichloro-2,2'-azobispropane, 1,1'-azo(methylethyl)diacetate, 2,2'-azobis(2-amidinopropane)hydrochloride, 2,2'-azobis(2-amidinopropane)-nitrate, 2,2'-azobisisobutane, 2,2'-azobisisobutylamide, 2,2'-azobisisobutyronitrile, methyl 2,2'-azobis-2-methylpropionate, 2,2'-dichloro-2,2'-azobisbutane, 2,2'-azobis-2-methylbutyronitrile, dimethyl 2,2'-azobisisobutyrate, 1,1'-azobis(sodium 1-methylbutyronitrile-3-sulfonate), 2-(4-methylphenylazo)-2-methylmalonodinitrile, 4,4'-azobis-4-cyanovaleric acid, 3,5-dihydroxymethylphenylazo-2-methylmalonodinitrile, 2-(4-bromophenylazo)-2-allylmalonodinitrile, 2,2'-azobis-2-methylvaleronitrile, dimethyl 4,4'-azobis-4-cyanovalerate, 2,2'-azobis-2,4-dimethylvaleronitrile, 1,1'-azobiscyclohexanenitrile, 2,2'-azobis-2-propylbutyronitrile, 1,1'-azobis-1-chlorophenylethane, 1,1'-azobis-1-cyclohexanecarbonitrile, 1,1'-azobis-1-cycloheptanenitrile, 1,1'-azobis-1-phenylethane, 1,1'-azobiscumene, ethyl 4-nitrophenylazobenzylcyanoacetate, phenylazodiphenylmethane, phenylazotriphenylmethane, 4-nitrophenylazotriphenylmethane, 1'-azobis-1,2-diphenylethane, poly(bisphenol A-4,4'-azobis-4-cyanopentano-ate) and poly(tetraethylene glycol-2,2'-azobisisobutyrate); 1,4-bis(pentaethylene)-2-tetrazene; 1,4-dimethoxycarbonyl-1,4-dipheny-l-2-tetrazene and the like; and mixtures thereof.

More typical free radical initiators include, but are not limited to, ammonium persulfate, hydrogen peroxide, acetyl peroxide, cumyl peroxide, tert-butyl peroxide, propionyl peroxide, benzoyl peroxide, chlorobenzoyl peroxide, dichlorobenzoyl peroxide, bromomethylbenzoyl peroxide, lauroyl peroxide, sodium persulfate, potassium persulfate, diisopropyl peroxycarbonate and the like.

Based on total weight of the monomers to be polymerized, the initiator may be present in an amount from about 0.1% to about 5%, from about 0.4% to about 4%, from about 0.5% to about 3%, although may be present in greater or lesser amounts.

A chain transfer agent optionally may be used to control the polymerization degree of the latex, and thereby control the molecular weight and molecular weight distribution of the product latexes of the latex process and/or the toner process according to the present disclosure. As can be appreciated, a chain transfer agent can become part of the latex polymer.

Chain Transfer Agent

In embodiments, the chain transfer agent has a carbon-sulfur covalent bond. The carbon-sulfur covalent bond has an absorption peak in a wave number region ranging from 500 to 800 cm-1 in an infrared absorption spectrum. When the chain transfer agent is incorporated into the latex and the toner made from the latex, the absorption peak may be changed, for example, to a wave number region of 400 to 4,000 cm-1.

Exemplary chain transfer agents include, but are not limited to, n-C3-15 alkylmercaptans, such as, n-propylmercaptan, n-butylmercaptan, n-amylmercaptan, n hexylmercaptan, n-heptylmercaptan, n-octylmercaptan, n-nonylmercaptan, n decylmercaptan and n-dodecylmercaptan; branched alkylmercaptans, such as, isopropylmercaptan, isobutylmercaptan, s-butylmercaptan, tert-butylmercaptan, cyclo hexyl mercaptan, tert-hexadecylmercaptan, tert-laurylmercaptan, tert nonylmercaptan, tert-octylmercaptan and tert-tetradecylmercaptan; aromatic ring containing mercaptans, such as, allylmercaptan, 3-phenylpropylmercaptan, phenylmercaptan and mercaptotriphenylmethane; and so on. The terms, mercaptan and thiol may be used interchangeably to mean C—SH group.

Examples of such chain transfer agents also include, but are not limited to, dodecanethiol, butanethiol, isooctyl-3-mercaptopropionate, 2-methyl-5-t-butyl-thiophenol, carbon tetrachloride, carbon tetrabromide and the like.

Based on total weight of the monomers to be polymerized, the chain transfer agent may be present in an amount from about 0.1% to about 7%, from about 0.5% to about 6%, from about 1.0% to about 5%, although may be present in greater or lesser amounts.

In embodiments, a branching agent optionally may be included in the first/second monomer composition to control the branching structure of the target latex. Exemplary branching agents include, but are not limited to, decanediol diacrylate (ADOD), trimethylolpropane, pentaerythritol, trimellitic acid, pyromellitic acid and mixtures thereof.

Based on total weight of the monomers to be polymerized, the branching agent may be present in an amount from about 0% to about 2%, from about 0.05% to about 1.0%, from about 0.1% to about 0.8%, although may be present in greater or lesser amounts.

In the latex process and toner process of the disclosure, emulsification may be done by any suitable process, such as, mixing at elevated temperature. For example, the emulsion mixture may be mixed in a homogenizer set at about 200 to about 400 rpm and at a temperature of from about 40° C. to about 80° C. for a period of from about 1 min to about 20 min.

Any type of reactor may be used without restriction. The reactor can include means for stirring the compositions therein, such as, an impeller. A reactor can include at least one impeller. For forming the latex and/or toner, the reactor can be operated throughout the process such that the impellers can operate at an effective mixing rate of about 10 to about 1,000 rpm.

Following completion of the monomer addition, the latex may be permitted to stabilize by maintaining the conditions for a period of time, for example for about 10 to about 300 min, before cooling. Optionally, the latex formed by the above process may be isolated by standard methods known in the art, for example, coagulation, dissolution and precipitation, filtering, washing, drying or the like.

The latex of the present disclosure may be selected for emulsion-aggregation-coalescence processes for forming toners, inks and developers by known methods. The latex of the present disclosure may be melt blended or otherwise mixed with various toner ingredients, such as, a wax dispersion, a coagulant, an optional silica, an optional charge enhancing additive or charge control additive, an optional surfactant, an optional emulsifier, an optional flow additive and the like. Optionally, the latex (e.g. around 40% solids) may be diluted to the desired solids loading (e.g. about 12 to about 15% by weight solids), before formulated in a toner composition.

Based on the total toner weight, the latex may be present in an amount from about 50% to about 100%, from about 60% to about 98%, from about 70% to about 95%, although may be present in greater or lesser amounts. Methods of producing such latex resins may be carried out as described in the disclosure of U.S. Pat. No. 7,524,602, herein incorporated by reference in entirety.

Neutralizing Agents

The acid groups present on the disclosed polyester and/or styrene acrylate polymers may be partially neutralized by the introduction of a neutralizing agent, such as a base solution, during neutralization (which occurs prior to aggregation of the hybrid latex particles). Suitable bases include but are not limited to ammonium hydroxide, potassium hydroxide, sodium hydroxide, sodium carbonate, sodium bicarbonate, lithium hydroxide, potassium carbonate, triethylamine, triethanolamine, pyridine and its derivatives, diphenylamine and its derivatives, poly(ethylene amine) and its derivatives, combinations thereof, and the like. After neutralization, the hydrophilicity, and thus the emulsifiability of the polymers, may be improved when compared with polymers that did not undergo such neutralization process.

Colorants

One or more colorants may be added to the slurry of hybrid latex particles, including but not limited to pigments, dyes, mixtures of pigments and dyes, mixtures of pigments, mixtures of dyes, and the like. The colorant may be, for example, carbon black, cyan, yellow, magenta, red, orange, brown, green, blue, violet or mixtures thereof.

The colorant may be present in the slurry of hybrid latex particles in an amount of from about 1% to about 25% by weight of solids (i.e. the slurry minus solvent), or from about 2% to about 15% by weight of solids, or from about 5% to about 10% by weight of solids.

Suitable colorants also include those colorants comprising carbon black, such as REGAL 330® and Nipex 35; magnetites, such as Mobay magnetites, MO8029™ and MO8060™; Columbian magnetites, such as MAPICO® BLACK; surface-treated magnetites; Pfizer magnetites, such as CB4799™, CB5300™, CB5600™ and MCX6369™; Bayer magnetites, such as BAYFERROX 8600™ and 8610™; Northern Pigments magnetites, such as NP604™ and NP608™; Magnox magnetites, such as TMB-100™ or TMB104™; and the like.

Colored pigments, such as cyan, magenta, orange, violet, brown, blue or mixtures thereof can be also be used, where the colored pigments exhibit a spectral response reflectance of R=0.20 or lower over the full spectral range, from about 400 to about 700 nm. The additional pigment or pigments may be used as water-based pigment dispersions.

Examples of suitable pigments include SUNSPERSE 6000, FLEXIVERSE and AQUATONE, water-based pigment dispersions from SUN Chemicals; HELIOGEN BLUE L6900™, D6840™, D7080™, D7020™, PYLAM OIL BLUE™, and PIGMENT BLUE I™ available from Paul Uhlich & Company, Inc.; PIGMENT VIOLET I™ available from Dominion Color Corporation, Ltd.; and the like.

Other known colorants may be used, such as Levanyl Black ASF (Miles, Bayer) and Sunsperse Carbon Black LHD 9303 (Sun Chemicals); and colored dyes, such as Neopen Blue (BASF), Sudan Blue OS (BASF), PV Fast Blue B2G 01 (American Hoechst), Sunsperse Blue BHD 6000 (Sun Chemicals), Irgalite Blue BCA (CibaGeigy), Paliogen Blue 6470 (BASF), Sudan Orange G (Aldrich), Sudan Orange 220 (BASF), Paliogen Orange 3040 (BASF), Ortho Orange OR 2673 (Paul Uhlich); combinations of the foregoing; and the like.

In some embodiments, portions of the pigment loading, for example furnace carbon black (e.g., Nipex 35), may be replaced by two or more second colorants or pigments that are not blacks. In certain embodiments, the pigment loading is increased by at least about 10%, or by at least about 20%, or by at least about 30% or more by replacing portions of the black with a set of color pigments that exhibit a spectral response that is substantially the same as carbon black and where such color pigments may be selected based on spectral response curve data.

In some embodiments, more than two colorants may be present in a toner particle. For example, three colorants may be present in a toner particle, such as a first colorant of pigment may be present in an amount ranging from about 1% to about 10% by weight, or from about 2% to about 8% by weight, or from about 3% to about 5% by weight of the toner particle on a solids basis; with a second colorant of pigment that may be present in an amount ranging of from about 1% to about 10% by weight, or from about 2% to about 8% by weight, or from about 3% to about 5% by weight of the toner particle on a solids basis; with a third colorant of pigment that may be present in an amount ranging of from about 1% to about 10% by weight, or from about 2% to about 8% by weight, or from about 3% to about 5% by weight of the toner particle on a solids basis.

Emulsifying Agents

One or more emulsifying agents or surfactants may be present in the slurry of hybrid latex particles, which may include any surfactant suitable for use in forming a latex. Surfactants which may be utilized during the emulsification stage in preparing latexes with the processes of the present disclosure include anionic, cationic, and/or nonionic surfactants.

Anionic surfactants which may be utilized include but are not limited to sulfates and sulfonates, sodium dodecylsulfate (SDS), sodium dodecylbenzene sulfonate, sodium dodecylnaphthalene sulfate, dialkyl benzenealkyl sulfates and sulfonates, acids such as abitic acid, combinations thereof, and the like. Other suitable anionic surfactants include DOWFAX® 2A1, an alkyldiphenyloxide disulfonate from The Dow Chemical Company, and/or TAYCA POWER BN2060 from Tayca Corporation (Japan), which are branched sodium dodecyl benzene sulfonates. Combinations of these surfactants and any of the foregoing anionic surfactants may be used. Anionic surfactants may be employed in any desired or effective amount, for example, at least about 0.01% by weight of total monomers used to prepare the latex polymer, at least about 0.1% by weight of total monomers used to prepare the latex polymer; and no more than about 10% by weight of total monomers used to prepare the latex polymer, no more than about 5% by weight of total monomers used to prepare the latex polymer, although the amount can be outside of those ranges.

Examples of nonionic surfactants include but are not limited to alcohols, acids and ethers, for example, polyvinyl alcohol, polyacrylic acid, methalose, methyl cellulose, ethyl cellulose, propyl cellulose, hydroxylethyl cellulose, carboxy methyl cellulose, polyoxyethylene cetyl ether, polyoxyethylene lauryl ether, polyoxyethylene octyl ether, polyoxyethylene octylphenyl ether, polyoxyethylene oleyl ether, polyoxyethylene sorbitan monolaurate, polyoxyethylene stearyl ether, polyoxyethylene nonylphenyl ether, dialkylphenoxy poly(ethyleneoxy) ethanol, mixtures thereof, and the like.

Examples of cationic surfactants include but are not limited to ammonium compounds, for example, alkylbenzyl dimethyl ammonium chloride, dialkyl benzenealkyl ammonium chloride, lauryl trimethyl ammonium chloride, alkylbenzyl methyl ammonium chloride, alkyl benzyl dimethyl ammonium bromide, benzalkonium chloride, and C12, C15, C17 trimethyl ammonium bromides, mixtures thereof, and the like. Other cationic surfactants include cetyl pyridinium bromide, halide salts of quaternized polyoxyethylalkylamines, dodecylbenzyl triethyl ammonium chloride, and the like, and mixtures thereof. The choice of particular surfactants or combinations thereof as well as the amounts of each to be used are within the purview of those skilled in the art.

Waxes

One or more waxes may be present in the aggregated particle slurry, which can be either a single type of wax or a mixture of two or more different types of waxes (hereinafter identified as, "a wax") as described herein. A wax can also be added to a toner formulation or to a developer formulation, for example, to improve particular toner properties, such as toner particle shape, charging, fusing characteristics, gloss, stripping, offset properties and the like. Alternatively, a combination of waxes can be added to provide multiple properties to a toner composition. A wax may be included as, for example, a fuser roll release agent. The wax may also be combined with the polymer forming composition for forming toner particles. When included, the wax may be present in an amount of, for example, from about 1 weight % to about 25 weight % of the toner particles, or from about 5 weight % to about 20 weight % of the toner particles, or from about 10 weight % to about 15 weight % of the toner particles.

Waxes that may be selected include waxes having, for example, a weight average molecular weight of from about 500 to about 20,000, or from about 1,000 to about 10,000, or from about 2,000 to about 8,000. Waxes that may be used include, for example, polyolefins, such as polyethylene, polypropylene and polybutene waxes, such as those that are commercially available, for example, POLYWAX™ polyethylene waxes from Baker Petrolite; wax emulsions available from Michaelman, Inc. or Daniels Products Co.; EPOLENE N15™ which is commercially available from Eastman Chemical Products, Inc.; VISCOL 550P™, a low weight average molecular weight polypropylene, available from Sanyo Kasei K.K.; plant-based waxes, such as carnauba wax, rice wax, candelilla wax, sumac wax and jojoba oil; animal-based waxes, such as beeswax; mineral-based waxes and petroleum-based waxes, such as montan wax, ozokerite, ceresin wax, paraffin wax, microcrystalline wax and Fischer-Tropsch waxes; ester waxes obtained from higher fatty acids and higher alcohols, such as stearyl stearate and behenyl behenate; ester waxes obtained from higher fatty acids and monovalent or multivalent lower alcohols, such as butyl stearate, propyl oleate, glyceride monostearate, glyceride distearate and pentaerythritol tetrabehenate; ester waxes obtained from higher fatty acids and multivalent alcohol multimers, such as diethyleneglycol monostearate, dipropyleneglycol distearate, diglyceryl distearate and triglyceryl tetrastearate; sorbitan higher fatty acid ester waxes, such as sorbitan monostearate; cholesterol higher fatty acid ester waxes, such as, cholesteryl stearate, and so on.

Examples of functionalized waxes that may be used include, for example, amines and amides, for example, AQUA SUPERSLIP 6550™ and SUPERSLIP 6530™ available from Micro Powder Inc.; fluorinated waxes, for example, POLYFLUO 190™, POLYFLUO 200™, POLYSILK 19™ and POLYSILK 14™ available from Micro Powder Inc.; mixed fluorinated amide waxes, for example, MICROSPERSION 19™ also available from Micro Powder Inc.; imides, esters, quaternary amines, carboxylic acids, acrylic polymer emulsions, for example, JONCRYL 74™, 89™, 130™, 537™ and 538™ available from SC Johnson Wax; and chlorinated polypropylenes and polyethylenes available from Allied Chemical, Petrolite Corp. and SC Johnson. Mixtures and combinations of the foregoing waxes also may be used in some embodiments.

Process for Preparing Toner Particles

Known emulsion aggregation procedure may be used and/or modified to prepare the hybrid toner particles of the present disclosure. In various embodiments, these procedures may include the steps of:

a) forming a slurry of hybrid latex particles by preparing a first emulsion containing a polyester polymer(s) and a styrene acrylate polymer(s), and optionally a colorant(s) or pigment(s), an emulsifying agent(s) (surfactants), a wax(es), an aggregating agent(s), a coagulant(s), and/or other optional additive(s);

b) aggregating the hybrid latex particles in the slurry to form aggregated hybrid latex particles;

c) adding a second emulsion containing a polyester polymer(s) and optionally a styrene acrylate polymer(s) (which may be the same or different than the first emulsion) to the aggregated hybrid latex particles, and further aggregating the particles to form a shell thereon;

d) coalescing the aggregated hybrid latex particles in a continuous coalescence process to form coalesced aggregated hybrid toner particles; and e) cooling and collecting the coalesced aggregated hybrid toner particles to provide hybrid toner particles suitable for use in a toner.

In embodiments, when using a continuous coalescence process, the coalesced aggregated hybrid toner particles have a core of a mixture of one or more polyester polymers and one or more styrene acrylate polymers, along with a shell exclusively of polyester polymers. In other embodiments, the shell is polyester polymers and may optionally include styrene acrylate polymers.

Continuous coalescence differs from batch coalescence mainly in the duration time of coalescence, which occurs on the order of minutes (<~3) for a continuous process compared to hours (~3 hours) for a batch process. This allows for the diffusion time to be reduced during coalescence as well as the use of higher temperatures without producing over-rounded particles (i.e., too high circularity).

As further described below, during the continuous coalescence process of the aggregated hybrid latex particles having a mixed core composition of a polyester polymer and a styrene acrylate polymer and a aggregated shell composition of polyester polymers, the styrene acrylate polymer from the core may be controllably diffused to the surface of the particles and coalesced to form hybrid toner particles with a core of polyester polymer/styrene acrylate polymer, along with a shell of comprised of both polyester and styrene acrylate polymers.

The controlled diffusion can occur by heating a slurry of the aggregated hybrid toner particles for a set amount of time (residence time) above the glass transition temperature of the toner polymers, and quenching the slurry to below the glass transition temperature. During the heating process, the rate of the increase in temperature and the residence time of the slurry above the glass transition temperature may be used to control the amount of styrene acrylate polymer that diffuses from the core to the surface of the particles. In embodiments, the residence time may be from about 0.5 minutes to about 5 minutes, or from about 0.75 minutes to about 3 minutes, or from about 1 minute to about 2 minutes.

Emulsification

The toner particles herein may be prepared by any method within the purview of one skilled in the art; for example, any of the phase inversion emulsification (PIE) methods may be used with the polymers and the optional components taught herein, while any known emulsion polymerization may be used for styrene acrylate.

Aggregation

Following preparation of the above latex particle mixture, it can be desirable to form larger particles or aggregates, often sized in micrometers, of the smaller particles from the initial polymerization reaction, often sized in nanometers. An aggregating factor may be added to the mixture. Suitable aggregating factors include, for example, aqueous solutions of a divalent cation, a multivalent cation or a compound comprising same. In some embodiments, the aggregating factor can be an inorganic cationic coagulant, such as, for example, polyaluminum chloride (PAC), polyaluminum sulfosilicate (PASS), aluminum sulfate, zinc sulfate, magnesium sulfate, chlorides of magnesium, calcium, zinc, beryllium, aluminum, sodium, and other metal halides including monovalent and divalent halides. The aggregating factor may be present in an emulsion in an amount of from about 0.01 to about 10 weight %, or from about 0.05 to about 5 weight %, or from about 0.1 to about 3 weight % based on the total solids in the toner particle. The aggregating factor may also contain minor amounts of other components, for example, nitric acid.

The aggregating factor may be added to the mixture at a temperature that is below the glass transition temperature (Tg) of the polymer. The aggregating factor may be added to the mixture components to form a toner in an amount of, for example, from about 0.1 pph to about 1 pph, or from about 0.25 pph to about 0.75 pph, or about 0.5 pph of the reaction mixture.

To control aggregation of the latex particles, the aggregating factor may be metered into the mixture over time. For example, the factor may be added incrementally into the mixture over a period of from about 5 to about 240 minutes, or from about 30 to about 200 minutes. Addition of the aggregating factor also may be done while the mixture is maintained under stirred conditions, for example, of from about 50 rpm to about 1,000 rpm, or from about 100 rpm to about 500 rpm; and at a temperature that is below the glass transition temperature of the polymer, for example, of from about 30° C. to about 90° C., or from about 35° C. to about 70° C. The growth and shaping of the latex particles following addition of the aggregation factor may be accomplished under any suitable condition(s).

The latex particles may be permitted to aggregate until a predetermined desired particle size is obtained. Particle size may be monitored during the growth process. For example, samples may be taken during the growth process and analyzed, for example, with a COULTER COUNTER, for average particle size. The aggregation thus may proceed by maintaining the mixture, for example, at elevated temperature, or slowly raising the temperature, for example, of from about 40° C. to about 100° C. or from about 50° C. to about 90° C., and holding the mixture at that temperature for example, of from about 0.5 hours to about 6 hours, or from about hour 1 to about 5 hours, while maintaining stirring, to provide the desired aggregated latex particles. Once the predetermined desired latex particle size is attained, the growth process is halted.

Once the desired final size of the latex particles or aggregates is achieved, the pH of the mixture may be adjusted with base to a value of from about 6 to about 10, or from about 6.2 to about 7. The adjustment of pH may be used to freeze, that is, to stop, latex particle growth. The base used to stop latex particle growth may be, for example, an alkali metal hydroxide, such as, for example, sodium hydroxide, potassium hydroxide, ammonium hydroxide, combinations thereof and the like. In some embodiments, EDTA may be added to assist adjusting the pH to the desired value. The base may be added in amounts of from about 2 to about 25% by weight or from about 4 to about 10% by weight of the mixture.

In some embodiments, a sequestering agent or chelating agent may be introduced during or after aggregation is complete to adjust pH and/or to sequester or to extract a metal complexing ion, such as aluminum, from the aggregation process. Thus, the sequestering, chelating or complexing agent used after aggregation is complete may comprise a complexing component, such as ethylenediaminetetraacetic acid (EDTA), gluconal, hydroxyl-2,2'iminodisuccinic acid (HIDS), dicarboxylmethyl glutamic acid (GLDA), methyl glycidyl diacetic acid (MGDA), hydroxy-diethyliminodiacetic acid (HIDA), sodium gluconate, potassium citrate, sodium citrate, nitrotriacetate salt, humic acid, fulvic acid; salts of EDTA, such as alkali metal salts of EDTA, tartaric acid, gluconic acid, oxalic acid, polyacrylates, sugar acrylates, citric acid, polyasparic acid, diethylenetriamine pentaacetate, 3-hydroxy-4-pyridinone, dopamine, *eucalyptus*, iminodisuccinic acid, ethylenediamine-disuccinate, polysaccharide, sodium ethylenedinitrilotetraacetate, thiamine pyrophosphate, farnesyl pyrophosphate, 2-aminoethylpyrophosphate, hydroxyl ethylidene-1,1-diphosphonic acid, aminotrimethylene phosphonic acid, diethylene triaminepentamethylene phosphonic acid, ethylenediamine tetramethylene phosphonic acid, and mixtures thereof.

For separate aggregation and coalescence stages, the aggregation process may be conducted under shearing conditions at an elevated temperature, for example, of from about 40° C. to about 90° C., or from about 45° C. to about 80° C., which may be below the glass transition temperature of the polymer.

In some embodiments, the aggregate latex particles may be of a size of less than about 3 μm, or from about 2 μm to about 6 μm, or from about 3 μm to about 5 μm.

Shell Covering

After aggregation, but prior to coalescence, a polymer coating may be applied to the aggregated latex particles to form a shell thereover. Any polymer described herein or as known in the art may be used as the shell. In some embodiments, one or more polyester polymers and/or one or more styrene acrylate polymers may be included in the shell.

A shell polymer may be applied to the aggregated latex particles by any method within the purview of those skilled in the art. In some embodiments, the polymer used to form the shell may be in an emulsion, optionally including any surfactant described herein. The emulsion possessing the polymer may be combined with the aggregated latex particles so that the shell forms over the aggregated particles. The formation of the shell over the aggregated particles may occur while heating to a temperature of from about 30° C. to about 80° C., or from about 35° C. to about 70° C., or from about 40° C. to about 60° C. The formation of the shell may take place for a period of time from about 5 minutes to about 10 hours, or from about 10 minutes to about 5 hours. The shell may be present in an amount of from about 1% by weight to about 80% by weight, or from about 10% by weight to about 40% by weight, or from about 20% by weight to about 35% by weight of the latex particle components.

Coalescence

Following aggregation to a desired particle size and application of a shell, the aggregated latex particles may be coalesced to a desired final shape, such as, for example, a circular shape, to correct for irregularities in the shape and size. The coalescence can be achieved through a continuous coalescence process as described in U.S. Patent Application Publication No. 20140295346, the disclosure of which is hereby incorporated by reference in its entirety.

Continuous coalescence can be achieved, for example, by first adjusting the pH of a slurry of an emulsion of aggregated latex particles downwards, i.e., to be more acidic. The aggregated particle slurry may then be heated in a first heat exchanger to a first temperature beyond the glass transition temperature of the polymer. The heated aggregated particle slurry then flows through a residence time reactor, wherein the particles coalesce to form a coalesced particle slurry. The coalesced particle slurry is then quenched to a second temperature below the glass transition temperature of the polymer. The quenching may occur, for example, in a second heat exchanger. After a sufficient residence time, the quenched coalesced particle slurry may be recovered.

For a continuous coalescence process, the prior emulsion aggregation process may also include adding one or more colorants or pigments, one or more emulsifying agents (surfactants), one or more waxes, one or more aggregating agents, one or more coagulants, or other optional additives, and mixing the emulsion with high shear to homogenize the mixture.

An exemplary continuous coalescence apparatus shown in FIG. 1 involves heating a slurry of aggregated toner particles above the glass transition temperature of the polymers, holding the heated slurry for a set amount of time (residence time), and then quenching the slurry to below the glass transition temperature of the polymers. The aggregated hybrid particle slurry may have a starting pH of about 5.0 to about 9.0, or from about 5.5 to 8.5, or from about 6.0 to about 8.0 prior to entering the first heat exchanger described below.

In FIG. 1, a feed tank 100 holds the aggregated slurry. The slurry moves from the feed tank 100 to heat exchangers 110 and 120 that are connected to heating utility (130).

Downstream of heat exchangers 110 and 120 is a residence time section 140 that can be a tube having a specified volume which holds the slurry at temperature for a certain residence time. Particle coalescence may begin in the heat exchangers, and then be completed in the residence time section 140. The function of the residence time section 140 may also be accomplished by sufficiently large heat exchangers such that the coalescence may be completed without flowing through a separate residence time reactor.

Further downstream are heat exchangers 150, 160 used to quench the toner to below its' glass transition temperature using domestic chilled water (~10° C.). The quenching can occur in any means known to those skilled in the art of process engineering.

In certain embodiments of a continuous coalescence process, the aggregated hybrid toner particle slurry may have a starting temperature of from ambient temperature to about 65° C. prior to entering the first heat exchanger 110, while the exiting temperature from heat exchanger 160 may be of from about 40° C. to about 10° C., or from about 30° C. to about 20° C., or about ambient temperature.

In embodiments, the heat exchanger 110 and 120 temperature may be from about 70° C. to about 110° C., or from about 80° C. to about 100° C., or form about 90° C. to about 100° C.

The residence time in the residence time section can be from about 0.5 minutes to about 5 minutes, or from about 0.75 minutes to about 3 minutes, or from about 1 minute to about 2 minutes, according to certain embodiments.

Optionally, a coalescing agent(s) may be used. Examples of suitable coalescing agents include but are not limited to benzoic acid alkyl esters, ester alcohols, glycol/ether-type solvents, long chain aliphatic alcohols, aromatic alcohols, mixtures thereof and the like. Examples of benzoic acid alkyl esters include those where the alkyl group, which may be straight or branched, substituted or unsubstituted, has from about 2 to about 30 carbon atoms, such as decyl or isodecyl benzoate, nonyl or isononyl benzoate, octyl or isooctyl benzoate, 2-ethylhexyl benzoate, tridecyl or isotridecyl benzoate, 3,7dimethyloctyl benzoate, 3,5,5-trimethylhexyl benzoate, mixtures thereof and the like. In some embodiments, the coalescing agent evaporates during later stages of the emulsion/aggregation process, such as during a second heating step that is generally above the glass transition temperature of the polymer. The final toner particles are thus free of, or essentially or substantially free of, any remaining coalescing agent. To the extent that any remaining coalescing agent may be present in a final toner particle, the amount of remaining coalescing agent is such that presence thereof does not affect any properties or the performance of the toner or developer.

The coalescing agent can be added prior to the coalescence or fusing step in any desired or suitable amount. For example, the coalescing agent may be added in an amount from about 0.01 to about 10% by weight, based on the solids content in the reaction medium. Of course, amounts outside those ranges can be used, as desired. In some embodiments, the coalescing agent can be added at any time between aggregation and coalescence, although in some embodiments it may be desirable to add the coalescing agent after aggregation is "frozen" or completed, for example, by adjustment of pH, for example, by addition, for example, of base. Following coalescence, the toner particles can be optionally cooled below the exit temperature from the continuous coalescence system. After cooling, the toner particles optionally may be washed with water and then dried. Drying may be accomplished by any suitable method for drying including, for example, freeze drying.

The circularity of the aggregated particles before the coalescence process may be between about 0.900 and about 0.940, whereas the circularity of the resulting toner particles recovered from the coalescence process may be between about 0.940 and about 0.999, or between about 0.960 to about 0.990, or between about 0.970 to about 0.980.

In embodiments, the coalesced toner particles may have a particle size from about 4 to about 8 μm, or from about 4.5 to about 7.5 μm, or from about 5 to about 7 μm, or from about 5.5 to about 6.5 μm, or about 6 μm (D50).

In embodiments, the coalesced toner particles may have an upper geometric standard deviation (GSD) by volume (coarse level) for (D84/D50) from about 1.10 to about 1.30, or from about 1.15 to about 1.25, or from about 1.20 to about 1.23. The geometric standard deviation (GSD) by number (fines level) for (D50/D16) may be from about 1.10 to about 1.30, or from about 1.15 to about 1.25, or from about 1.23 to about 1.25.

Surface Additives

In some embodiments, the coalesced hybrid toner particles may be mixed with one or more surface additives, such as silicon dioxide or silica ($SiO_2$), titania or titanium dioxide ($TiO_2$), and/or cerium oxide. These additives may enhance toner flow, tribo control, admix control, improved development and transfer stability, and higher toner blocking temperature. The surface additive(s) may be used with or without a coating or shell.

In some embodiments, silica may include a first silica and a second silica. The first silica may have an average primary particle size, measured in diameter, in the range of, for example, from about 5 nm to about 50 nm, or from about 5 nm to about 25 nm, or from about 20 nm to about 40 nm. The second silica may have an average primary particle size, measured in diameter, in the range of, for example, from about 100 nm to about 200 nm, or from about 100 nm to about 150 nm, or from about 125 nm to about 145 nm. The second silica may have a larger average size (diameter) than the first silica.

Titania may have an average primary particle size in the range of, for example, about 5 nm to about 50 nm, or from about 5 nm to about 20 nm, or from about 10 nm to about 50 nm.

Cerium oxide may have an average primary particle size in the range of, for example, from about 5 nm to about 50 nm, or from about 5 nm to about 20 nm, or from about 10 nm to about 50 nm.

Zinc stearate also may be used as an additive. Calcium stearate and magnesium stearate may provide similar functions. Zinc, calcium or magnesium stearate may also provide developer conductivity, tribo enhancement, higher toner charge, and charge stability. Zinc stearate may have an average primary particle size in the range of, for example, from about 500 nm to about 700 nm, or from about 500 nm to about 600 nm, or from about 550 nm to about 650 nm.

Surface additives may be used in an amount of from about 0.1 to about 10 weight %, or from about 0.5 to about 7 weight %, or from about 1% to about 5 weight % of the hybrid toner particles.

Other examples of surface additives include those disclosed in U.S. Pat. Nos. 3,590,000; 3,720,617; 3,655,374; and 3,983,045, the disclosures of which are hereby incorporated by reference in their entireties.

The gloss of a toner may be influenced by the amount of retained metal ion, such as, $Al^{3+}$, in a particle. The amount of retained metal ion may be adjusted further by the addition of a chelator, such as EDTA. In some embodiments, the amount of retained catalyst, for example, $Al^{3+}$, in the hybrid toner particles of the present disclosure may be from about 0.1 pph to about 1 pph, or from about 0.25 pph to about 0.8 pph. The gloss level of a toner of the instant disclosure may have a gloss, as measured by Gardner gloss units (gu), of from about 20 gu to about 100 gu, or from about 50 gu to about 95 gu, or from about 60 gu to about 90 gu.

Other surface additives include lubricants, such as, a metal salt of a fatty acid (e.g., calcium stearate) or long chain alcohols, such as, UNILIN 700 available from Baker Petrolite and AEROSIL R972® available from Degussa. The coated silicas of U.S. Pat. Nos. 6,190,815 and 6,004,714 may also be useful, the disclosures of which are hereby incorporated by reference in their entireties.

Toner Compositions—Developer(s)

The hybrid toner particles thus formed may be formulated into a developer composition. For example, the hybrid toner particles may be mixed with carrier particles to achieve a two component developer composition. The hybrid toner particle concentration in the developer may be from about 1% to about 25% by weight, or from about 2% to about 15% by weight of the total weight of the developer, with the remainder of the developer composition being the carrier. However, different hybrid toner particles and carrier percentages may be used to achieve a developer composition with desired characteristics.

Toner Compositions—Carrier(s)

A toner composition optionally can comprise inert particles, which can serve as hybrid toner particle carriers. The inert particles can be modified, for example, to serve a particular function. Hence, the surface thereof can be derivatized or the hybrid toner particles can be manufactured for a desired purpose, for example, to carry a charge or to possess a magnetic field. Examples of carrier particles for mixing with the hybrid toner particles include those carrier particles that are capable of triboelectrically obtaining a charge of polarity opposite to that of the toner particles. Illustrative examples of suitable carrier particles include granular zircon, granular silicon, glass, steel, nickel, ferrites, iron ferrites, silicon dioxide, one or more polymers and the like. Other carriers include those disclosed in U.S. Pat. Nos. 3,847,604; 4,937,166; and 4,935,326, the disclosures of which are hereby incorporated by reference in their entireties.

In some embodiments, the carrier particles may include a core with a coating thereover, which may be formed from a polymer or a mixture of polymers that are not in close proximity thereto in the triboelectric series, such as those as taught herein or as known in the art. The coating may include fluoropolymers, such as polyvinylidene fluorides, terpolymers of styrene, methacrylates, methyl methacrylates, cyclohexylmethacrylates, copolymers of cylohexyl methacrylates with alklymines meth(acrylates) such as dimethylaminoethyl methacrylate, silanes, such as triethoxy silanes, tetrafluoroethylenes, other known coatings and the like. For example, coatings containing polyvinylidene fluoride available, for example, as KYNAR 301F™, and/or polymethylmethacrylate (PMMA), for example, having a weight average molecular weight of about 300,000 to about 350,000, such as commercially available from Soken, may be used. In some embodiments, PMMA and polyvinylidenefluoride may be mixed in proportions from about 30 to about 70 weight % to about 70 to about 30 weight %, or from about 40 to about 60 weight % to about 60 to about 40 weight %. The coating may have a coating weight of, for example, from about 0.1 to about 5% by weight, or from about 0.5 to about 2% by weight of the carrier. The carrier particles may be prepared by mixing the carrier core with a polymer in an amount of from about 0.05% to about 10% by weight, or from about 0.01% to about 3% by weight, based on the weight of the coated carrier particle, until adherence thereof to the carrier core is obtained, for example, by mechanical impaction and/or electrostatic attraction.

Toner Compositions—Charge Additives

The toner compositions may include any known charge additives in amounts of from about 0.1 to about 10 weight %, or from about 0.5 to about 7 weight % of the toner composition. Examples of such charge additives include alkyl pyridinium halides, bisulfates, the charge control additives of U.S. Pat. Nos. 3,944,493; 4,007,293; 4,079,014; 4,394,430; and 4,560,635, the disclosures of which are hereby incorporated by reference in their entireties, negative charge enhancing additives, such as aluminum complexes, and the like. Charge enhancing molecules can be used to impart either a positive or a negative charge on a toner particle. Examples include quaternary ammonium compounds, as for example in U.S. Pat. No. 4,298,672, the disclosure of which is hereby incorporated by reference in its entirety, organic sulfate and sulfonate compounds, as for example in U.S. Pat. No. 4,338,390, the disclosure of which is hereby incorporated by reference in its entirety, cetyl pyridinium tetrafluoroborates, distearyldimethyl ammonium methylsulfate, aluminum salts and so on.

Toner Compositions—Surfactant(s)

The toner compositions may be in dispersions including surfactants. The surfactants may be selected from ionic surfactants and nonionic surfactants, or combinations thereof as described herein. Anionic surfactants and cationic surfactants are encompassed by the term "ionic surfactants." The surfactant or the total amount of surfactants in a toner composition may be used in an amount of from about 0.01% to about 5%, or from about 0.05% to about 3%, or from about 0.1% to about 2% by weight of the toner composition.

Examples of suitable processes for forming toner particles from latex particles may be found in U.S. Pat. No. 8,192,913, the disclosure of which is hereby incorporated by reference in its entirety.

EXAMPLES

The following Examples illustrate exemplary embodiments of the present disclosure. These Examples are intended to be illustrative only to show one of several methods of preparing the toner particles herein and are not intended to limit the scope of the present disclosure. Also, parts and percentages are by weight unless otherwise indicated.

Example 1

Preparation of an Aggregated Toner Slurry

In a 20 gal reactor, 3.4 kg of an amorphous polyester latex (polyester emulsion A, an amorphous polyester resin in an emulsion, having an average molecular weight (Mw) of about 86,000, a number average molecular weight (Mn) of about 5,600, an onset glass transition temperature (Tg onset) of about 56° C., and about 35% solids), 3.4 kg of a second amorphous polyester latex (Polyester emulsion B, an amorphous polyester resin in an emulsion having an Mw of about 19,400, an Mn of about 5,000, a Tg onset of about 60° C., and about 35% solids), 6.0 kg of a styrene-n-butyl-acrylate latex (emulsion polymerized latex of about 200 nm size with 76.5% styrene and 23.5% nBA, a Mw of 35,000 and a Tg onset of about 51° C., and about 40% solids), 2.1 kg of a crystalline polyester (CPE, a crystalline polyester resin in an emulsion, having an Mw of about 23,300, an Mn of about 10,500, a melting temperature (Tm) of about 71° C. and about 35.4% solids;), 4.2 kg of a carbon black pigment dispersion (Nipex 35), 0.7 kg of a cyan pigment dispersion (PB15:3), 3.4 kg of a wax dispersion (polyethylene wax in an emulsion, having a Tm of about 90° C., and about 30% solids;), and 33 kg deionized (DI) water was charged. This material was pH adjusted to 4.2 using 0.3M nitric acid and homogenized using a closed loop homogenizer attached to the reactor while a mixture of 0.2 kg poly aluminum chloride solution and 2.4 kg 0.02M nitric acid solution was added over a period of 5 minutes. The homogenizer was run for a period of 30 minutes before another 2 kg of DI water was added to flush the homogenizer loop. The reactor was then mixed at approximately 275 RPM while the temperature was ramped to 45° C. over approximately 2 hours to yield a core particle size of 4.44 μm comprising a mixed-composition hybrid core. A shell formulation comprising 2.7 kg of a first amorphous polyester latex (Polyester emulsion A) and 2.7 kg of a second amorphous polyester latex (polyester emulsion B), was pH adjusted to 3.3 using 0.3M nitric acid solution and charged to the reactor. The jacket temperature was then raised to 53° C. with an impeller speed of 335 RPM and the shell composition was allowed to aggregate onto the core particles for a period of approximately 80 minutes. The particles were then 'frozen' (aggregation stopped) by addition of a 1M solution of sodium hydroxide to yield a pH of 4.2 where the agitation speed was then reduced to 150 RPM, and then the addition of a chelating agent (Versene 100-EDTA) in the amount of 0.4 kg (EDTA to toner ratio of 1.5 ppH). This material had a final particle size of 5.90 μm, a GSDv84/50 of 1.22, and a GSDn50/16 of 1.26. This material was used as the feed material in subsequent continuous coalescence examples below.

Example 2

Preparation of a Continuously Coalesced Toner Particle Slurry

Approximately 4 L of aggregated slurry from Example 1 was pH adjusted to 6.2 and charged to feed reactor (100) as denoted in FIG. 1. The reactor was then pressurized to 40 psi with compressed air using a pressure regulator. A peristaltic pump at the outlet of the process seen in FIG. 1 was set to meter the flow of slurry through the system at 240 mL/min from the feed tank, through the heat exchangers and residence time section, to the pump out of the system to be collected. The slurry first travels through two shell tube heat exchangers and heated to an outlet temperature of 93° C. (exiting 110 and 120). The slurry then enters the residence time section (140) having a volume of 240 mL yielding a residence time of 1 minute. The slurry then passes through the final two quenching heat exchangers (150 and 160) which are cooled by domestic chilled water (~10° C.) to yield an outlet temperature of approximately 25° C. The slurry then is metered through the pump and collected. The collected toner was measured by a Sysmex FPIA-2100 and the resulting circularity was found to be 0.954. The particle size measured by a Beckman Coulter Multisizer 3 (50 μm aperture tube) was 5.83 μm (D50v) with a GSDv84/50 of 1.23 and a GSDn50/16 of 1.28.

Example 3

Preparation of a Continuously Coalesced Toner Particle Slurry

Approximately 4 L of aggregated slurry from Example 1 was pH adjusted to 5.8 and charged to feed reactor (100) as denoted in FIG. 1. The reactor was then pressurized to 40 psi with compressed air using a pressure regulator. A peristaltic pump at the outlet of the process seen in FIG. 1 was set to meter the flow of slurry through the system at 240 mL/min from the feed tank, through the heat exchangers and residence time section, to the pump and out of the system to be collected. The slurry first travels through two shell tube heat exchangers and heated to an outlet temperature of 95° C. (exiting (110 and 120). The slurry then enters the residence time section (140) having a volume of 240 mL yielding a residence time of 1 minute. The slurry then passes through the final two quenching heat exchangers (150 and 160) which are cooled by domestic chilled water (~10° C.) to yield an outlet temperature of approximately 25° C. The slurry then is metered through the pump and collected. The collected toner was measured by a Sysmex FPIA-2100 and the resulting circularity was found to be 0.954. The particle size measured by a Beckman Coulter Multisizer 3 (50 μm aperture tube) was 5.83 μm (D50v) with a GSDv84/50 of 1.23 and a GSDn50/16 of 1.27.

Example 4

Preparation of a Batch Aggregation and Continuous Coalescence Toner, with Mixed Core Composition and Aggregated Polyester Shell In a 4 L reactor, 171 g of an amorphous polyester latex (polyester emulsion A), 171 g of a second amorphous polyester latex (Polyester emulsion B), 300 g of a styrene-n-butylacrylate latex (Emulsion polymerized latex of about 200 nm size with 76.5% styrene and 23.5% nBA, a Mw of 35,000 and a Tg onset of about 51° C., and about 40% solids.), 109 g of a crystalline polyester (a crystalline polyester resin in an emulsion, having an Mw of about 23,300, an Mn of about 10,500, a melting temperature (Tm) of about 71° C. and about 35.4% solids), 215 g of a carbon black pigment dispersion (Nipex 35), 36 g of a cyan pigment dispersion (PB15:3), 172 g of a wax dispersion (polyethylene wax in an emulsion, having a Tm of about 90° C., and about 30% solids;), and 1.5 kg deionized (DI) water was charged. This material was pH adjusted to 4.2 using 0.3M nitric acid and homogenized using a probe homogenizer (IKA Ultra Turrax T-50) at 3000-4000 RPM while a mixture of 134 g aluminum sulphate solution added over a period of 5 minutes. The reactor was then mixed at approximately 200 RPM to 160 RPM while the temperature was ramped to 46° C., over approximately 50 minutes to yield a core particle size of 4.6 μm comprising a mixed-composition hybrid core. A shell formulation comprising 270 g of a first amorphous polyester latex (Polyester emulsion A) and 270 g of a second amorphous polyester latex (Polyester emulsion B). The pH was adjusted to 3.3 using 0.3M nitric acid solution and charged to the reactor. The jacket temperature was then raised to 52° C. with an impeller speed of 150 RPM and the shell composition was allowed to aggregate onto the core particles for a period of approximately 70 minutes, ramping to a temperature of about 51° C. The particles were then 'frozen' (aggregation stopped) by addition of a 1M solution of sodium hydroxide to yield a pH of 4.2 where the agitation speed was then reduced to 90 RPM, and then the addition of a chelating agent (Versene 100-EDTA) in the amount of 21.5 g (EDTA to toner ratio of 1.5 ppH). After freeze, the material was ramped to 65° C. at 150 RPM and held for 10 minutes before being discharged and cooled to room temperature overnight. This material had a final particle size of 6.55 μm, a GSDv84/50 of 1.220 and a GSDn50/16 of 1.299. The aggregated slurry was then pH adjusted using 0.3M nitric acid from 7.6 to 6.0 at room temperature and charged to feed reactor (100) as denoted in FIG. 1. The reactor was then pressurized to 40 psi with compressed air using a pressure regulator. A peristaltic pump at the outlet of the process seen in FIG. 1 was set to meter the flow of slurry through the system at 240 mL/min from the feed tank, through the heat exchangers and residence time section, to the pump out of the system to be collected. The slurry first travels through two shell tube heat exchangers and heated to an outlet temperature of about 92° C. (exiting 110 and 120). The slurry then enters the insulated residence time section (140) having a volume of 240 mL yielding a residence time of about 1 minute and exits at a temperature of about 92° C. The slurry then passes through the final two quenching heat exchangers (150 and 160) which are cooled by domestic chilled water (~10° C.) to yield an outlet temperature of approximately 32° C. The slurry then is metered through the pump and collected. The collected toner was measured by a Sysmex FPIA-3000 and the resulting circularity was found to be 0.973. The particle size measured by a Beckman Coulter Multisizer 3 (50

μm aperture tube) was 6.41 μm (D50v) with a GSDv84/50 of 1.25 and a GSDn50/16 of 1.37.

Example 5

Preparation of a Batch Aggregation and Continuous Coalescence Toner, with Mixed Core Composition and Aggregated Polyester Shell In a 4 L reactor, 171 g of an amorphous polyester latex (polyester emulsion A), 171 g of a second amorphous polyester latex (Polyester emulsion B), 300 g of a styrene-n-butylacrylate latex (Emulsion polymerized latex of about 200 nm size with 76.5% styrene and 23.5% nBA, a Mw of 35,000 and a Tg onset of about 51° C., and about 40% solids.), 109 g of a crystalline polyester (a crystalline polyester resin in an emulsion, having an Mw of about 23,300, an Mn of about 10,500, a melting temperature (Tm) of about 71° C. and about 35.4% solids), 215 g of a carbon black pigment dispersion (Nipex 35), 36 g of a cyan pigment dispersion (PB15:3), 172 g of a wax dispersion (polyethylene wax in an emulsion, having a Tm of about 90° C., and about 30% solids;), and 1.5 kg deionized (DI) water was charged. This material was pH adjusted to 4.2 using 0.3M nitric acid and homogenized using a probe homogenizer (IKA Ultra Turrax T-50) at 3000-4000 RPM while a mixture of 134 g aluminum sulphate solution added over a period of 5 minutes. The reactor was then mixed at approximately 190 RPM while the temperature was ramped to 48° C., over approximately 70 minutes to yield a core particle size of 4.7 μm comprising a mixed-composition hybrid core. A shell formulation comprising 270 g of a first amorphous polyester latex (Polyester emulsion A) and 270 g of a second amorphous polyester latex (Polyester emulsion B). The pH was adjusted to 3.3 using 0.3M nitric acid solution and charged to the reactor. The jacket temperature was then raised to 52° C. with an impeller speed of 145 RPM and the shell composition was allowed to aggregate onto the core particles for a period of approximately 165 minutes. The particles were then 'frozen' (aggregation stopped) by addition of a 1M solution of sodium hydroxide to yield a pH of 4.2 where the agitation speed remained at 150 RPM, and then the addition of a chelating agent (Versene 100-EDTA) in the amount of 21.5 g (EDTA to toner ratio of 1.5 ppH). After freeze, the material discharged and cooled to room temperature overnight. This material had a final particle size of 6.76 μm, a GSDv84/50 of 1.18 and a GSDn50/16 of 1.25. The aggregated slurry was then pH adjusted using 0.3M nitric acid from 7.6 to 6.0 at room temperature and charged to feed reactor (100) as denoted in FIG. 1. The reactor was then pressurized to 50 psi with compressed air using a pressure regulator. A peristaltic pump at the outlet of the process seen in FIG. 1 was set to meter the flow of slurry through the system at 240 mL/min from the feed tank, through the heat exchangers and residence time section, to the pump out of the system to be collected. The slurry first travels through two shell tube heat exchangers and heated to an outlet temperature of about 93° C. (exiting 110 and 120). The slurry then enters the insulated residence time section (140) having a volume of 240 mL yielding a residence time of about 1 minute and exits at a temperature of about 92° C. The slurry then passes through the final two quenching heat exchangers (150 and 160) which are cooled by domestic chilled water (~10° C.) to yield an outlet temperature of approximately 27° C. The slurry then is metered through the pump and collected. The collected toner was measured by a Sysmex FPIA-3000 and the resulting circularity was found to be 0.978. The particle size measured by a Beckman Coulter Multisizer 3 (50 μm aperture tube) was 6.48 μm (D50v) with a GSDv84/50 of 1.20 and a GSDn50/16 of 1.25.

Results

The fusing performance of the particles produced in Examples 2, 3, 4, and 5 are characterized by a wider fusing latitude than EA-Eco toner, a commercially available polyester based toner used as a reference. The fusing results are summarized in Table 1 below.

TABLE 1

Summary of fusing results for Examples 2 and 3.

| | EA-HG Toner | EA-Eco Toner | Example 2 | Example 3 |
|---|---|---|---|---|
| Cold Offset (° C.) | 140 | 127 | 117 | 113 |
| MFT (° C.) | 141 | 123 | 119 | 119 |
| Gloss Mottle (° C.) | 210 | 200 | >210 | >210 |
| Hot Offset (° C.) | >210 | 210 | >210 | >210 |

TABLE 2

Summary of fusing results for Example 4:

| | EA-HG Toner | EA-Eco Toner | Example 4 |
|---|---|---|---|
| Cold Offset (° C.) | 137 | 123 | 117 |
| MFT (° C.) | 140 | 124 | 118 |
| Gloss Mottle (° C.) | 205 | 195 | 200 |
| Hot Offset (° C.) | >210 | 210 | >210 |

TABLE 3

Summary of fusing results for Example 5:

| | EA-HG Toner | EA-Eco Toner | Example 5 |
|---|---|---|---|
| Cold Offset (° C.) | 137 | 127 | 127 |
| MFT (° C.) | 140 | 123 | 122 |
| Gloss Mottle (° C.) | 205 | 200 | 205 |
| Hot Offset (° C.) | >210 | 210 | >210 |

As shown in Table 1, the MFT (crease area=80) of the toner particles prepared according to Examples 2, 3, 4, and 5 are about 1° C. to 6° C. less than the MFT for EA-Eco Toner and are about 10° C. to 22° C. less than the MFT for EA-HG Toner (EA-Eco Toner is commercially available polyester based toners and EA-HG is a commercially available styrene/acrylate toner). The toners of Examples 2, 3, 4, and 5 also do not hot offset at 210° C., which is greater than the hot offset temperatures of the EA-Eco and similar to the hot offset temperatures of EA-HG Toners. It can be seen that the fusing performance of the disclosed hybrid toners exceed that of EA-Eco and EA-HG Toners.

It will be appreciated that variations of the above-disclosed and other features and functions, or alternatives thereof, may be desirably combined into many other different systems or applications. Also that various, presently unforeseen or unanticipated, alternatives, modifications, variations or improvements therein may be subsequently made by those skilled in the art which are also intended to be encompassed by the following claims.

What is claimed is:

1. A method to produce toner comprising first aggregating at least one polyester latex, and at least one styrene acrylate latex, and optionally a wax dispersion, and optionally a pigment dispersion to form a core, wherein polyester latex particles are aggregated onto the core to form a shell, wherein the resulting aggregated particle is subjected to a continuous coalescence process, comprising:

heating the aggregated particle to a first temperature beyond its glass transition temperature in a first heat exchanger to form a coalesced particles;

quenching the coalesced particles to a second temperature below the glass transition temperature after a residence time; and recovering the quenched coalesced particles at an outlet;

wherein the circularity of the aggregated particles is from about 0.900 to about 0.940, and the circularity of the particles in the coalesced particle slurry has increased to a value from about 0.940 to about 0.999;

wherein the resulting toner comprises a hybrid composition with both styrene/acrylate and polyester.

2. The method of claim 1, wherein the first temperature of continuous coalescence is from about 70° C. to about 110° C.

3. The method of claim 1, wherein the continuous coalescence residence time is from about 0.5 minutes to about 5 minutes.

4. The method of claim 1, wherein the heated hybrid particles exit the first heat exchanger and coalesces in a residence time reactor to form the coalesced particle slurry.

5. The method of claim 1, wherein the toner particles are aggregated by a continuous process.

6. The method of claim 1, wherein the toner particles are aggregated by a batch process.

7. The method of claim 1, wherein the toner particles have a particle size of from about 4 to about 8 μm (D50v).

8. The method of claim 1, wherein the toner particles have a number average geometric standard deviation (GSDn50/16) of from about 1.10 to about 1.40.

9. A toner composition, comprising:

toner particles having a core and a shell;

wherein the core comprises at least a first polyester polymer and at least a first styrene acrylate polymer; and optionally a wax dispersion, and optionally a pigment dispersion;

wherein the shell comprises substantially a second polyester polymer and optionally a second styrene acrylate polymer.

10. The toner composition of claim 9, wherein the first and second polyester polymers are the same.

11. The toner composition of claim 9, wherein the first and second polyester polymers are different.

12. The toner composition of claim 9, wherein the first and second styrene acrylate polymers are the same.

13. The toner composition of claim 9, wherein the first and second styrene acrylate polymers are different.

14. The method of claim 9, further comprising diffusing the styrene acrylate polymer from the core to surfaces of the toner particles.

15. A method of preparing a toner composition, comprising:

forming toner particles having a core and a shell, wherein forming includes coalescing the toner particles by a continuous coalescence process, wherein the core includes at least one polyester polymer and at least one styrene acrylate polymer, and optionally a wax dispersion, and optionally a pigment dispersion;

wherein the toner particles have a fusing latitude of from about 100° C. to about 240° C.

16. The toner composition of claim 15, wherein the toner particles have a cold offset temperature of from about 100° C. to about 125° C.

17. The toner composition of claim 15, wherein the toner particles have a minimum fix temperature of from about 100° C. to about 130° C.

18. The toner composition of claim 15, wherein the toner particles have a hot offset temperature of from about 200° C. to about 240° C.

* * * * *